United States Patent [19]

Meihofer

[11] 4,021,002

[45] May 3, 1977

[54] AUTO-SPLICE SYSTEM

[75] Inventor: Edward F. Meihofer, Norfolk, Mass.

[73] Assignee: Butler Automatic, Inc., Canton, Mass.

[22] Filed: June 23, 1976

[21] Appl. No.: 699,191

Related U.S. Application Data

[63] Continuation-in-part of Ser. No. 589,365, June 23, 1975, abandoned.

[52] U.S. Cl. ..... 242/58.1; 242/57

[51] Int. Cl.[2] ..... B65H 19/18; B65H 25/04

[58] Field of Search ..... 242/58.1, 58.2, 58.3, 242/58.4, 58.5, 57; 156/502, 504

[56] References Cited

UNITED STATES PATENTS

| | | | |
|---|---|---|---|
| 3,232,548 | 2/1966 | Bent | 242/58.1 |
| 3,305,189 | 2/1967 | Butler | 242/58.1 |
| 3,516,617 | 6/1970 | Haner | 242/58.2 |
| 3,663,806 | 5/1972 | Drankham | 242/57 |
| 3,738,587 | 6/1973 | Cristiani | 242/58.1 |
| 3,746,272 | 7/1973 | Rotolo | 242/58.3 |
| 3,858,819 | 1/1975 | Butler | 242/58.3 |

*Primary Examiner*—Edward J. McCarthy
*Attorney, Agent, or Firm*—Cesari and McKenna

[57] ABSTRACT

An automatic web splice control system determines when an expiring roll of web of indeterminate caliper reaches a preselected splice radius by sensing when the web roll has diminished to preset first and second radii and measuring the web length resulting from that diminishment to determine web caliper. Then the system computes the roll cross-sectional area between the second radius and the preselected splice radius divided by that caliper to determine in advance the web length that will be drawn from a roll as the roll size diminishes from the second radius to the splice radius. Commencing at the second radius, the system then measures the amount of web drawn from the roll and when that amount equals the precomputed web length, the system generates a splice signal indicating that the roll has diminished to the preselected splice radius.

12 Claims, 3 Drawing Figures

AUTO-SPLICE SYSTEM

RELATED APPLICATION

This application is a continuation-in-part of application Ser. No. 589,365, filed June 23, 1975, now abandoned entitled AUTO-SPLICE SYSTEM.

BACKGROUND OF THE INVENTION

This invention relates to an automatic splice control system.

It relates more specifically to a system of this type which determines when an expiring web roll has reached a preselected splice radius.

Automatic web splicers are well known in the art. Examples are disclosed in U.S. Pat. Nos. 3,305,189 and 3,858,819. Generally, these splicers have a running web roll and a ready web roll. When the former roll is about to expire, a splice sequence is initiated which splices the leading end of the ready web to the expiring end of the running web so that web can proceed uninterruptedly to a web-consuming machine such as a printing press.

Typically, also, the splicing sequence is initiated when the running roll reaches a predetermined minimum size and there exist various types of roll radius measuring devices for detecting when the roll has reached the selected splice radius (i.e., a few wraps from the roll core). These devices include follower arms, photoelectric cells, which measure roll size directly. Other conventional splicers monitor roll size by measuring the angular velocities of the running roll and a fixed diameter guide roller.

In many splicers, however, particularly those already in the field, it is not convenient to mount the photocells, tachometers or other devices wich measure roll size because of congestion or obstructions near the roll core. There are some roll-size monitoring systems which do not need equipment in the vicinity of the roll core. However, those systems require that the caliper of the web on each roll be measured by hand prior to each run which is a bothersome chore and impractical to do in many situations.

SUMMARY OF THE INVENTION

Accordingly, the present invention aims to provide an automatic web splice control system which initiates a splice sequence at a preselected minimum web roll radius even at very high web speeds.

Another object of the invention is to provide a system of this type whose determination of the splice radius is independent of web caliper.

A further object is to provide a system for sensing when a web roll has reached a preselected minimum radius which requires no equipment in the vicinity of the web roll core.

Yet another object of this invention is to provide a splice radius control system which has a fast response.

A further object of the invention is to provide a system of this type which is comprised of a relatively few standard electrical components and, therefore, whose cost is minimum.

A further object of the invention is to provide a splice radius control system which is easily adjustable from a remote location to leave a selected length of web on an expiring web roll core at the time of the splice.

Other objects will in part be obvious and will in part appear hereinafter.

The invention accordingly comprises the features of construction, combination of elements and arrangement of parts which will be exemplified in the constructions hereinafter set forth, and the scope of the invention will be indicated in the claims.

Briefly, the present splice radius control system generates a splice signal when an expiring web roll reaches a preselected minimum radius that leaves only a few web wraps on the roll core. This signal can then be used to initiate a splice sequence during which the leading end of a roll of ready web is spliced to the expiring web so that web can proceed uninterruptedly to a web-consuming machine.

Instead of sensing when the roll has reached the preselected splice radius by monitoring the roll size directly, the present system monitors the amount of web drawn from the roll as the roll size diminishes from a preset first radius to a preset second radius, and from this determines the caliper of the web. With this information, the system then computes the amount of web that will have to be drawn from the roll in order for the roll size to diminish from the preset second radius to the preselected splice radius. Commencing at the second radius, the system then monitors the length of web drawn from the roll. When that length equals the computed amount, a signal is issued which signifies that the roll size has diminished to the preselected splice radius.

The present arrangement includes conventional photosensors which are positioned adjacent the roll to detect when the roll size reaches the first and second radii. These sensors can be positioned radially outward from the roll core and support chucks, on the roll chuck support arms, for example, where there is no congestion or obstructions.

A tachometer associated with a fixed diameter guide roller over which the web is trained or other means for monitoring the length of web passing a reference point generates pulses representing the length of web drawn from the roll. A counter starts counting these pulses when the outer sensor detects that the roll has diminished to the first radius and stops counting these pulses when the inner sensor detects that the roll size has diminished to the second radius so that, at that instant, the count in the counter represents the length of the web drawn from the roll as its size diminished from the first to the second radius.

This length is then divided into the cross-sectional area of the roll between the two present radii which is computed from the radius information to yield the caliper of the web.

Then the system computes the cross-sectional area of the roll between the second radius and the preselected splice radius in the same way and that area is divided by the computed web caliper to provide a number representing the length of web that will have to be drawn from the roll to reduce its size from the second radius to the preselected splice radius. Finally, the system counts pulses from the tachometer until the number of pulses equals the computed number, whereupon it emits an electrical signal to initiate the splice sequence.

Thus, the system makes all of the necessary calculations and determinations before the preselected splice radius is reached. Consequently, it issues the splice signal exactly when the roll reaches the preselected radius. Furthermore, the splice signal is generated at exactly the right time, regardless of the caliper of the web. Consequently, there is minimum web wastage and no need to change any settings or make any adjustments when handling different thickness webs.

In addition, the system has no components near the web roll core or support chucks so that it can be retrofit on most conventional splicers with minimum cost and effort.

While we have described the system as determining when an unwinding web roll diminishes to a selected radius, it has equal application to determine when a winding roll reaches a selected maximum radius.

BRIEF DESCRIPTION OF THE DRAWINGS

For a fuller understanding of the nature and objects of the invention, reference should be had to the following detailed description taken in connection with the accompanying drawings in which.

DESCRIPTION OF THE PREFERRED EMBODIMENTS

Figure 1:
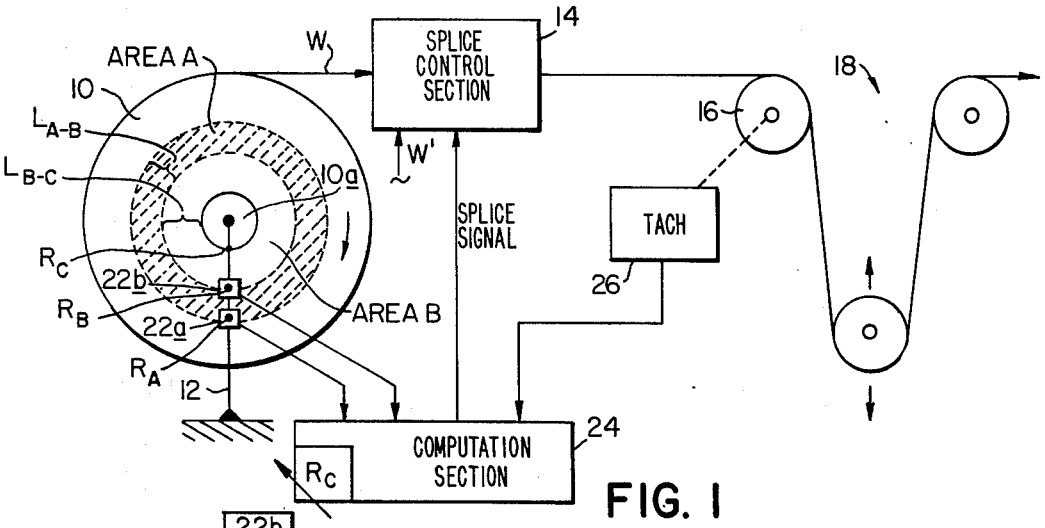
FIG. 1 is a diagrammatic and block view of a splicer incorporating a splice control system made in accordance with this invention.

Referring now to FIG. 1 of the drawings, a roll 10 of web W is supported at its opposite ends by chucks on a pair of roll stand arms, one of which is indicated at 12. Web W drawn from the roll passes through a splice control section 14, around a fixed diameter guide roller 16 and into an accumulator shown genrally at 18. From the accumulator, the web proceeds to a web-consuming machine (not shown) such as a high-speed printing press which draws the web from roll 10 at a constant speed.

When the roll 10 is about to expire, i.e., when a few wraps of web W remain about the roll core 10*a*, a splice sequence is initiated so that section 14 splices the trailing end of the expiring web W to the leading end of a ready web W′ which has previously been prepared and positioned at splice control section 14. When the splice sequence is initiated, the running roll 10 is braked to a stop. As soon as the roll has come to a standstill, section 14 joins the two webs W and W′ and severs the expiring web W upstream from the splice and then the ready web W′ is accelerated to line speed. The accumulator 18 stores a sufficient quantity of web so that during the splice sequence, web can proceed uninterruptedly to the web-consuming machine.

In accordance with the invention, the splice sequence is initiated when the expiring roll 10 reaches a preselected minimum radius near the roll core 10*a*. However, the system does not sense that splice radius directly. Rather, it calculates the amount of web W that must be drawn from roll 10 in order for the roll size to diminish from a preset known radius to the preselected splice radius. Then it determines that the splice radius has been reached by monitoring the amount of web being drawn from the roll after the roll has reached the preset radius. When the calculated amount of web has left the roll, the system immediately issues a splice signal indicating that the roll size has reached the preselected splice radius.

Further, the operation of the system is independent of web caliper so that the splice signal is produced at the proper time despite changes in web thickness from roll to roll.

Still referring to FIG. 1, a pair of photosensors 22*a* and 22*b* are mounted on roll stand arm 12. A pair of light sources (not shown) are mounted on the opposite ends of roll 10 so that each light source sensor pair sights along the roll 10 cylinder at the roll 10 radius where each pair is located. In practice, the sensor 22*a* (and its light source) detect when the roll 10 has reached a first preset radius $R_A$. This radius $R_A$ can be any radius, but is usually less than the initial roll 10 radius. The sensor 22*b* (and its light source) detect when the roll 10 has diminished to a second preset radius $R_B$ less then radius $R_A$, but well away from the roll core 10*a*. The radii $R_A$ and $R_B$ can remain the same for all webs. The splice radius $R_C$ is usually selected to leave a few wraps of web W on the roll core 10*a*.

When the roll 10 diminishes to the radius $R_A$, the detctor 22*a* applies a signal to a computation section 24. Similarly, when the roll size decreases to radius $R_B$, the detector 22*b* applies a similar signal to section 24. Section 24 determines the roll 10 cross-sectional area between radii $R_A$ and $R_B$ (the shaded area A in FIG. 1) by performing the following calculation:

$$A=\pi(R_A^2-R_B^2) \tag{1}$$

The section 24 then determines the web length $L_{A-B}$ contained in area A by counting pulses from a tachometer 26 driven by guide roller 16 which, for convenience, has a unit circumference. If the counter counts P counts per inch of drawn web, then $L_{A-B}=P\times$ the number $N_{A-B}$ of pulses. This area and web length information is then processed in section 24 to provide the caliper C of the web as follows:

$$C=\pi\frac{(R_A^2-R_B^2)}{L_{A-B}}=\pi\frac{(R_A^2-R_B^2)}{PN_{A-B}} \tag{2}$$

As the size of roll 10 continues to diminish toward splice radius $R_C$, section 24 determines the cross-sectional area B of roll 10 between radii $R_B$ and $R_C$ as follows:

$$B=\pi(R_B^2-R_C^2) \tag{3}$$

Then section 24 computes the web length $L_{B-C}$ that will have to be drawn from roll 10 in order to reduce its size from radius $R_B$ to radius $R_C$, i.e., in area B, as follows:

$$L_{B-C}=PN_{B-C}=\pi\frac{(R_B^2-R_C^2)}{C}=\rho\frac{(R_B^2-R_C^2)N_{A-B}P}{R_A^2-R_B^2} \tag{4}$$

When roll 10 reaches radius $R_B$, section 24 commences counting pulses from tachometer 26. As soon as the count equals the previously calculated number $N_{B-C}$, the preselected splice radius $R_C$ will have been reached and section 24 immediately issues a SPLICE signal to splice control section 14. The splice radius is set initially as desired by a front panel adjustment $R_C$ on section 24.

Figure 2:
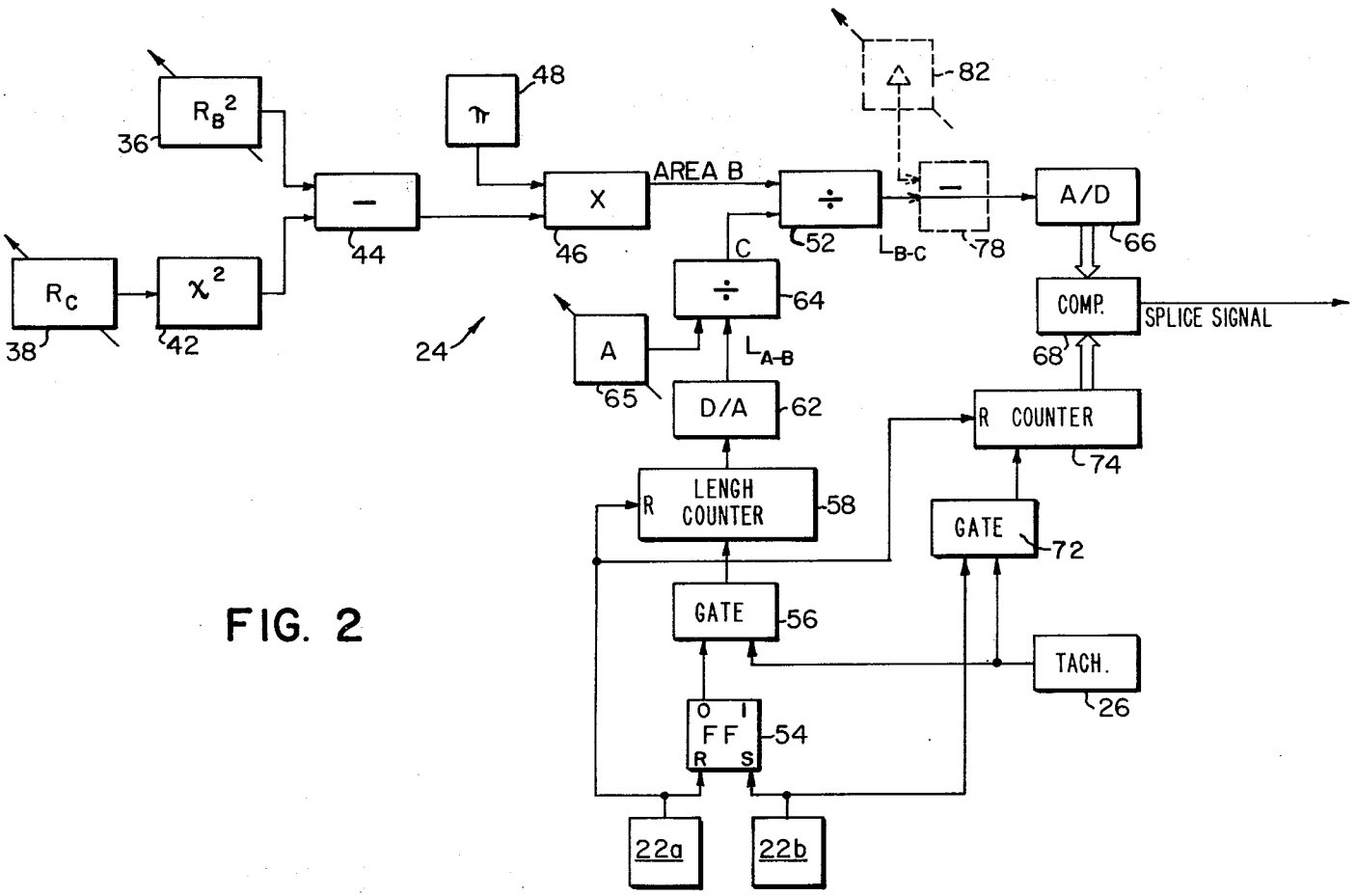
FIG. 2 is a block diagram showing elements of the FIG. 1 system in greater detail.

Referring now to FIG. 2, the computation section 24 that performs the aforesaid calculations is comprised of conventional electrical components. More particularly, an adjustable d.c. voltage source 36 provides a voltage representing the radius $R_B$ squared and a similar source 38 is set by the front panel control in section 24 to produce a d.c. voltage representing the preselected splice radius $R_C$. The latter voltage is applied by way of a squaring circuit 42 to a subtracting circuit 44 whose output is a voltage representing $R_B^2-R_C^2$. The voltage is then applied to a multiplying circuit 46 along with the voltage from a fixed d.c. source 48 representing the value $\pi$ (3.1416). Thus, the output of circuit 46 which is applied to a dividing circuit 52 represents the cross-sectional area of roll 10 between radii $R_B$ AND $R_C$, i.e., Area B (FIG. 1) in accordance with Equation (3). Alternatively the output of circuit 44 can be coupled to circuit 52 via a potentiometer (not shown) which is adjusted to provide the properly scaled input to circuit 52.

In order to determine the caliper C of the web W, the output of the photosensor 22*a* is applied to reset a flip flop 54. The ZERO output of the flip flop then enables a gate 56. When enabled, gate 56 applies pulses from tachometer 26 to a counter 58. Counter 58 counts these pulses until the roll 10 size decreases to radius $R_B$, whereupon the output of photosensor 22*b* sets flip flop 54. This terminates the enabling pulse to gate 56 so that the count then in counter 58 represents the web length $L_{A-B}$ in the hatched area A between radii $R_A$ and $R_B$.

The contents of counter 58 are applied via a digital-to-analog converter 62 to a dividing circuit 64. Circuit 64 also receives a voltage from an adjustable d.c. source 65 representing the value of the area A determined by Equation (1). Consequently, the output of circuit 64 reflects the caliper C of the web in accordance with Equation (2). This voltage is also applied to dividing circuit 52. Thus, the output of circuit 52 represents the web length $L_{B-C}$ between radii $R_B$ and $R_C$ in accordance with Equation (4). This length information is converted to digital form by an analog-to-digital converter 66 and applied to a comparator 68.

Pulses from tachometer 26 are also applied by way of a gate 72 to a counter 74. Gate 72 is enabled by a signal from sensor 22*b* so that counter 74 commences counting those pulses the instant that the roll 10 reaches radius $R_B$.

The contents of counter 74 are applied in parallel to comparator 68 and when the count of that counter equals the number in converter 66, comparator 68 emits a splice signal indicating that the amount of web drawn from roll 10 equals the precomputed web length $L_{B-C}$ and that the roll size has diminished to splice radius $R_C$.

The counters 58 and 74 can be reset at the beginning of each run by the leading edge of the signal from sensor 22*a*.

Thus, section 24 carries out all of its computations to calculate the web length $L_{B-C}$ between the preset radius $R_B$ and the preselected splice radius $R_C$ before that splice radius is reached. Consequently, as soon as the counter 74 counts the computed number of tachometer pulses, the SPLICE signal immediately issues so that the splice sequence is completed before the trailing end of web 10 leaves the roll core 10*a* even though only a few web wraps remain on the core.

If desired, section 24 may include provision for leaving a selected amount of web on roll core 10*a* above the preselected splice radius $R_C$ independent of web caliper C. This simply involves connecting a subtracting circuit between divider 52 and converter 66 as indicated in dotted lines at 78, and subtracting from the output of dividing circuit 52 a voltage from an adjustable d.c. source indicated in dotted lines at 82 representing the desired web length to be left on the roll above the splice radius $R_C$, e.g. 15 feet. This arrangement provides a finer adjustment of the remaining web length than would result from simply increasing the preselected splice radius $R_C$.

The only adjustments to the present system are electrical ones, i.e., preset sources 36 and 65 and the adjustable sources 38 and 82. Accordingly, the adjustments can all be made at a remote location away from the web roll 10, its support structure and the entire splicer if need be.

From Equations (2) and (4), it is seen that if $L_{A-B}=\lambda L_{B-C}$, then $R_C^2=2R_B^2-R_A^2$. Thus, by properly adjusting the preset radii $R_A$ and $R_B$, the splice radius $R_C$ will be independent of web caliper.

Implementation of the present system can be simplified by observing from the foregoing that Equation (4) can be rewritten as follows:

$$\frac{N_{B-C}}{N_{A-B}}=\frac{K_1^2(1-K_0^2)}{(1-K_1^2)} \tag{5}$$

Where $R_C=K_0R_B$ $R_B=K_1R_A$

The expression $$\frac{K_1^2}{1-K_1^2}$$

is constant once the radii $R_A$ and $R_B$ have been set and this expression equals unity if $R_A$ is selected to equal $\sqrt{2}R_B$. Thus, Equation (5) becomes $$\frac{N_{B-C}}{N_{A-B}}=(1-K_0^2) \tag{6}$$

If the splice radius were to be zero, then $N_{B-C}$ would equal $N_{A-B}$. Therefore, one could count up the number of tachometer 26 pulses as the roll diminishes from radius $R_A$ to radius $R_B$. At the latter radius, one could commence counting down by the same scale. When the count reaches zero, the radius $R_C$ will have been reached and the roll 10 would be exhausted.

Since the splice radius $R_C$ is normally selected to be some radius greater than zero, it is necessary to count down at a faster rate than was used to count up so that the counter will decrement to zero before the roll 10 is exhausted.

For example, assume that radius $R_B$ is preset to 6 inches (and $R_A$ to 6 $\sqrt{2}$=8.49 inches), and splice radius $R_C$ is selected to be 3 inches. Then, from Equation (6), $N_{B-C}=\frac{3}{4}N_{A-B}$. In other words, if the counter counts up and down at the same rate, i.e., 64 counts per revolution of the tachometer 26, when the down count reaches zero, only three-fourths of the web left on roll 10 will be expired. Consequently, for the zero count to reflect complete web expiration, the counter should be counted down one quarter faster than it was counted up. In other words, the counter should be decremented by 64 (or some other number greater than 48 and preferably a power of 2) for every 48 pulses from tachometer 26. When the count in the counter reaches zero, the 3 inch splice radius $R_C$ will have been reached.

Figure 3:
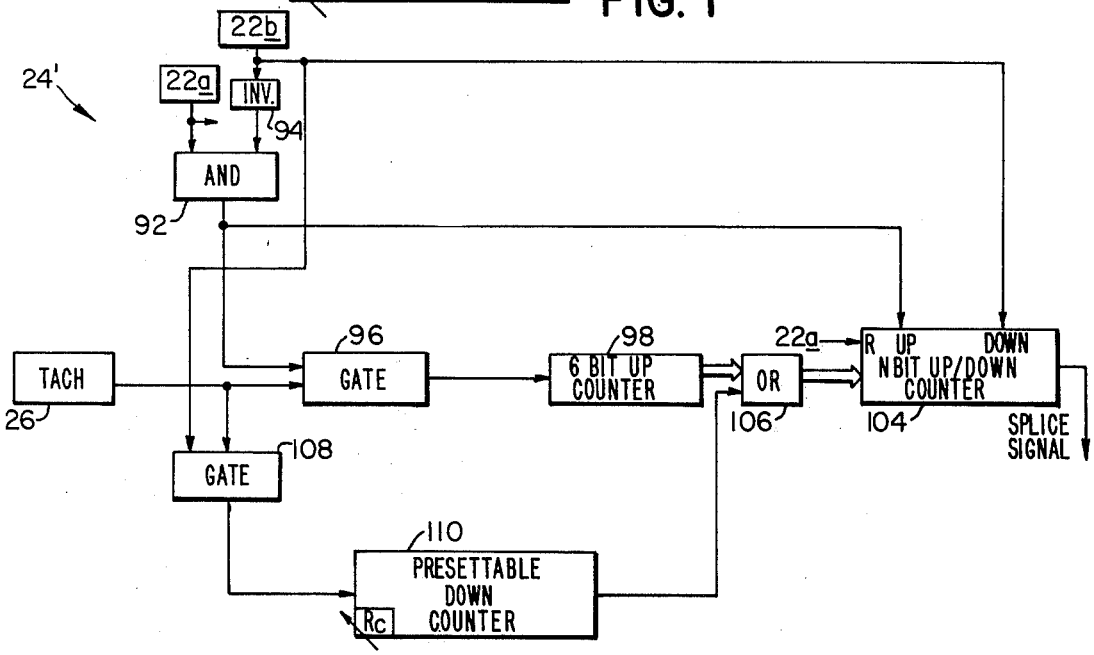
FIG. 3 is a block diagram showing a modified system embodiment.

FIG. 3 illustrates a modified computation section 24' which performs the above calculations.

An AND circuit 92 receives the outputs of sensors 22*a* and 22*b*, the latter by way of an inverter 94. When the roll 10 diminishes to radius $R_A$, the output of circuit 92 enables a gate 96 which applies pulses from tachometer 26 to a 6 bit up counter 98 cascaded with an N bit up/down counter 104 via an OR circuit 106.

The output of circuit 92 is also applied to the UP control input of counter 104 causing it to count up from radius $R_A$ to $R_B$. Thus, the counters 98 and 104 operate as a single UP counter from radius $R_A$ to $R_B$ so that when the roll size reaches $R_B$, the count in the counter represents $N_{A-B}$ in Equation (6).

As a numerical example, assume that the guide roller 16 (FIG. 1) has a circumference of 18 inches and that tachometer 26 provides 64 pulses per revolution and that $R_A$ and $R_B$ are preset to 8.49 and 6 inches, respectively. If the web caliper C is 0.01 inch, then there would be about 940 feet of web between $R_A$ and $R_B$, i.e., $L_{A-B}$=940. This would run in about 600 revolutions of roller 16 so that at a radius $R_B$, counters 98 and 104 together would contain a count of about 39,000. Since the system counts down by 64's, at radius $R_B$, the presence of the output from sensor 22*b* disables gate 96, thus taking counter 98 out of the system and effectively dividing the number in the counter 98, 104 by $2^6$ or 64. Thus, at radius $R_B$, that quotient corresponds to the number of revolutions made by roller 16 as roll 10 diminished from $R_A$ to $R_B$, i.e., about 600 in this example. The sensor 22*b* output also switches counter 104 to its count-down mode and enables a gate 108 which applies the tachometer 26 pulses to a presettable down counter 110.

To provide a SPLICE signal at a radius $R_C$ of 3 inches, counter 110 is preset to 48 as described above. Each time that counter counts down to zero, it resets to 48 and applies a pulse via OR circuit 106 to counter 104. Upon receipt of each pulse from counter 110, the counter 104 is decremented by 1 so that the number in the counter at radius $R_B$ (i.e., about 600) is reduced by 64. When that count reaches zero, the roll 10 size will have diminished to 3 inches and the counter thereupon issues a SPLICE signal to control section 14 (FIG. 1). The counter 104 is reset at the beginning of each sequence, say, by the leading edge of the pulse from sensor 22*a*.

If web of a different caliper C is to be run, the number 48 preset into counter 110 is not changed, nor is the number 64, since both of these are independent of web caliper. However, the total count in counters 98 and 104 at radius $R_B$ does change inversely with caliper.

The relationship of the number preset into counter 110 to the selected splice radius $R_C$ is non-linear and, for convenience, would be obtained from a suitable table of values. If the radii $R_A$ and $R_B$ can be preset and remain the same, only one table is required; otherwise, different tables should be provided for each set of radii.

Instead of using spaced photosensors to detect the first and second radii, the first radius can be calculated by determining the ratio of the roll radius to the radius of roller 16 (FIG. 1). Specifically, using a single pulse pickup or photocell pickup, a single revolution of roll 10 can be detected. During this single revolution, the number of pulses from tachometer 16 are counted. This count is proportional to the radius of roll 10 after the first revolution of roll 10. A second lesser radius is calculated in the same way. This second radius can be the one resulting after the second revolution of roll 10. Using any suitable calculating means it is possible to calculate the two roll areas corresponding to the two radii. Then, as before, the two areas are subtracted to produce the difference area A.

It will be appreciated further that the data developed by the present system can be used to generate signals to perform many useful control functions. For example, the web footage-remaining figure ($L_{B-C}$) resulting from Equation 4 can be compared with several preset control footages $L_{x1}$, $L_{x2}$ . . . $L_{xn}$ to determine if signals should be generated to cause changes in machine operations, e.g. cause web speed changes, produce splice warnings, splices, etc. To illustrate, if $L_{B-C}$ is 50 feet and it is desired to issue a splice warning or to slow down the machine at $L_{x1}$ = 25 feet before $R_C$ is reached, the output of tachometer 26 can be gated by the output of photosensor 22*b* to an adjustable counter (not shown) preset to a count corresponding to 25 feet of web (i.e., $$N = \frac{25 \times 12}{P}$$

When the counter counts that number of pulses corresponding to $L_{x1}$, it emits the requisite control signal.

Also since tachometer 26 is producing pulses at a rate which is exactly proportional to web speed, the pulses produced in a known time period can be counted to provide web surface speed (i.e., web speed $$(S) = \frac{PN}{\text{Time } (T)}\ ).$$

With the footage remaining ($L_{B-C}$) known along with the control footage and surface speed, the time to a splice or speed change control point $$\left(T_{x1} = \frac{L_{x1}}{S}\right)$$

is easily determined.

Finally, since the time required to make a splice is essentially constant for a given machine, the control footage can be trimmed automatically depending upon surface speed S to compensate for the varying web length which a fixed time represents depending on the surface speed. Thus the system control panel can display, at the option of the operator, web surface speed (S), web footage remaining to control point $L_{x1}$, $L_{x2}$ . . ., web caliper (C), time at present speed to control point ($T_{x1}$, $T_{x2}$ . . .), present roll diameter (R), total roll footage (L), set core radius ($R_C$) and web footage at all preset control points ($L_{x1}$, $L_{x2}$ . . .).

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

I claim:

1. An apparatus for determining independently of web caliper that a moving web roll has reached a preselected radius comprising A. sensing means to detect when the roll has reached a first known radius, and a second known radius, B. means responsive to the output of the sensing means for generating a first value dependent upon the cross-sectional area of the roll between said known radii, C. means for generating a second value dependent upon the cross-sectional area of the roll between said second known radius and the preselected radius, D. means for generating a third value proportional to the length of web being drawn to or from the roll that results as the roll size changes from one known radius to the other known radius, E. means for processing the three values to determine the length of web between the second known radius and the preselected radius, and F. means for monitoring the length of web traveling to or from the roll beginning when the roll size reaches the second known radius, said monitoring means producing an output signal when the monitored web length equals said determined length.

2. The apparatus defined in claim 1 wherein said first and second sensing means comprise photodetectors A. positioned adjacent to the web roll, and B. arranged to detect light when the roll reaches the first and second known radii, respectively.

3. The apparatus defined in claim 1 wherein the means for generating the third value comprise A. a fixed-diameter guide roller around which the web from the roll is trained, B. means for counting the number of revolutions of the guide roller, C. means for enabling the counting means when the roll radius equals the first known radius, and D. means for disabling the counting means when the roll radius equals the second known radius so that the contents of the counting means represent the length of web drawn over the guide roller as the roll size changed from said one known radius to the other known radius.

4. The apparatus defined in claim 3 wherein

A. said counting means comprise a tachometer driven by the guide roller which produces electrical pulses in response to rotation of the roller, and B. the counting means count pulses from the tachometer as the roll size changes from one known radius to the other known radius.

5. An apparatus for determining independently of web caliper that a moving web roll has reached a selected radius comprising A. first sensing means for determining when the roll has reached a first radius, B. second sensing means for determining when the roll has reached a second radius, C. first means responsive to the sensing means for generating a value representing the cross-sectional area of the roll between said first and second radii, D. second means for generating a second value representing the cross-sectional area of the roll between the second radius and the selected splice radius, E. means for obtaining the ratio of the second quantity to the first quantity, F. third means for generating a third value representing the length of web that must be drawn to or from the roll as the roll size changes from the first radius to the second radius, G. means for obtaining the product of said ratio and said third value to obtain a fourth value representing the length of web on the roll between the second radius and the selected splice radius, and H. means for monitoring the length of web drawn to or from the roll beginning when the roll size reaches the second radius, said monitoring means producing a splice signal when the monitored web length value equals said fourth value.

6. The apparatus defined in claim 1 and further including means for shortening the determined length by a fixed amount prior to its comparison with the monitored length so that upon the occurrence of said output signal an added length of web equal to said fixed amount remains on the roll.

7. The apparatus defined in claim 4 wherein the sensing means comprise

A. means for counting the number of pulses produced during first and second revolutions of the roll to reach the first and second radii, and B. means for determining from the counts the roll cross-sectional areas corresponding to the two roll radii reached after the first and second revolutions.

8. The apparatus defined in claim 4 and further including means for counting the number of pulses generated during a selected time period to provide an indication of web speed.

9. The system defined in claim 8 and further including means for determining from the outputs of the comparing means, processing means, and counting means the time remaining to said control values.

10. The apparatus defined in claim 1 and further including

A. means for establishing one or more control web footage remaining values, and

B. means for comparing the monitored web length to each footage remaining value and producing a control signal when the two are equal.

11. The apparatus defined in claim 10 and further including means for adjusting the control values depending on web speed to compensate for varying web length that a fixed time represents for a given web speed.

12. A method of determining independently of web caliper that a web roll has reached a preselected radius comprising the steps of A. sensing when a web roll has reached a first radius and a second radius, B. generating a first value dependent upon the cross-sectional area of the roll between said radii, C. generating a second value dependent upon the cross-sectional area between said second radius and the preselected radius, D. generating a third value proportional to the length of web drawn to or fromm the roll that results as the roll size changes from the first to the second radius, E. processing the three values to determine the length of web between the second radius and the preselected radius, and F. monitoring the length of web travelling to or from the roll beginning when the roll size reaches the second radius to produce a signal when the monitored web length equals the determined length.

* * * * *